US011071423B2

(12) United States Patent
Gong et al.

(10) Patent No.: US 11,071,423 B2
(45) Date of Patent: Jul. 27, 2021

(54) ASSEMBLY-AND-DISASSEMBLY STRUCTURE FOR TOILET COVER

(71) Applicant: Bestter (Xiamen) Technology Inc., Xiamen (CN)

(72) Inventors: Binhua Gong, Xiamen (CN); Rongmin Chen, Xiamen (CN); Linhuang Guo, Xiamen (CN)

(73) Assignee: Bestter (Xiamen) Technology Inc., Xiamen (CN)

( * ) Notice: Subject to any disclaimer, the term of this patent is extended or adjusted under 35 U.S.C. 154(b) by 0 days.

(21) Appl. No.: 16/887,394

(22) Filed: May 29, 2020

(65) Prior Publication Data

US 2020/0288927 A1 Sep. 17, 2020

Related U.S. Application Data

(63) Continuation of application No. PCT/CN2018/118209, filed on Nov. 29, 2018.

(30) Foreign Application Priority Data

Nov. 29, 2017 (CN) ..... 201711258484.X

(51) Int. Cl.
*A47K 13/26* (2006.01)
*A47K 13/12* (2006.01)

(52) U.S. Cl.
CPC ..... *A47K 13/26* (2013.01); *A47K 13/12* (2013.01)

(58) Field of Classification Search
CPC ..... A47K 13/26; A47K 13/12
USPC ..... 4/236
See application file for complete search history.

(56) References Cited

FOREIGN PATENT DOCUMENTS

| | | | |
|---|---|---|---|
| CN | 102512114 | A | 6/2012 |
| CN | 103099580 | A | 5/2013 |
| CN | 205144434 | U | 4/2016 |
| CN | 107960942 | A | 4/2018 |
| EP | 2946709 | A1 | 11/2015 |
| WO | 9115984 | A1 | 10/1991 |

OTHER PUBLICATIONS

International Search Report and Written Opinion with English Translation of ISR, cited in PCT/CN2018/118209 dated Mar. 6, 2019, 14 pages.

*Primary Examiner* — Christine J Skubinna
(74) *Attorney, Agent, or Firm* — Cooper Legal Group, LLC

(57) ABSTRACT

The present disclosure discloses an assembly-and-disassembly structure for a toilet cover, which comprises a cover plate assembly, two support bases, and two rotation shafts. A torsion spring is disposed between the first locking rod and the second locking rod. A first end of the torsion spring is movably connected to the first locking rod, and a second end of the torsion spring is connected to the second locking rod. The second locking rod comprises a torsion spring fixing portion. An outer end of the first locking rod comprises a first locking plate, and an inner end of the first locking rod comprises a sliding groove structure configured to receive the first end of the torsion spring to move.

17 Claims, 8 Drawing Sheets

ASSEMBLY-AND-DISASSEMBLY STRUCTURE FOR TOILET COVER

RELATED APPLICATIONS

This application is a continuation of and claims priority to International Patent Application PCT/CN2018/118209, filed on Nov. 29, 2018, which claims priority to Chinese Patent Application 201711258484.X, filed on Nov. 29, 2017. International Patent Application PCT/CN2018/118209 and Chinese Patent Application 201711258484.X are incorporated herein by reference.

FIELD OF THE DISCLOSURE

The present disclosure relates to an assembly-and-disassembly structure for a toilet cover.

BACKGROUND OF THE DISCLOSURE

A toilet comprises a ceramic main body and a cover plate. The cover plate comprises a top cover and a toilet seat. The cover plate is connected to the ceramic main body by a support base and a rotating shaft. There are various types of quick assembly-and-disassembly structures for the cover plate of the toilet. However, most of these structures require buttons to operate. When operating using buttons, a person needs to place his thumb on the buttons to perform a pressing operation and then move his hand to another portion of the cover plate in order to easily lift the cover plate. Although this operation can achieve quick assembly-and-disassembly, it still requires two steps. Moreover, most of the buttons are arranged at the end of the cover plate, which is easily dirtied.

BRIEF SUMMARY OF THE DISCLOSURE

The present disclosure provides a toilet cover that does not require a button to overcome the disadvantages of the toilet cover in the existing techniques.

The technical solutions adopted by the present disclosure to solve the technical problems are:

An assembly-and-disassembly structure for a toilet cover, comprises a cover plate assembly, two support bases, and two rotation shafts. The cover plate assembly is connected to the two support bases by the two rotation shafts. A first locking rod and a first locking rod resetting device are disposed in a first rotation shaft of the two rotation shafts, and a second locking rod and a second locking rod resetting device are disposed in a second rotation shaft of the two rotation shafts. A torsion spring is disposed between the first locking rod and the second locking rod, a first end of the torsion spring is movably connected to the first locking rod, a second end of the torsion spring is connected to the second locking rod, and the second locking rod comprises a torsion spring fixing portion. An outer end of the first locking rod comprises a first locking plate, and an inner end of the first locking rod comprises a sliding groove structure configured to receive the first end of the torsion spring to move. The sliding groove structure comprises a V-shaped groove and a strip-shaped groove connected to the V-shaped groove. Each of the two support bases comprises a support abutting block, and the two support abutting blocks comprise sliding portions configured to respectively abut the first locking rod and the second locking rod to drive the first locking rod and the second locking rod to move laterally. When the two support abutting blocks respectively abut the first locking rod and the second locking rod to bring the first locking rod close to the second locking rod, the first end of the torsion spring is configured to move to a bottom of the V-shaped groove, and the first locking rod and the second locking rod separate from locking grooves of the two support bases. When the two support abutting blocks respectively abut the first locking rod and the second locking rod to separate the first locking rod from the second locking rod, the first end of the torsion spring is configured to move to the strip-shaped groove, and the first locking rod and the second locking rod are locked to the locking grooves of the two support bases.

In a preferred embodiment, an upper side of an inner side of the first locking rod protrudes to define a V-shaped block comprising the V-shaped groove, and a rear side of the V-shaped groove is disposed with a V-shaped guide surface. A side surface of the V-shaped block comprises a block wall, and the strip-shaped groove is disposed between the block wall and the V-shaped block. A bottom of the strip-shaped groove is higher than an upper surface of the first locking rod, and an intersection of the strip-shaped groove and the bottom of the strip-shaped groove (2.08-3) defines a step.

In a preferred embodiment, a vertical surface of the step is an inclined surface, the inclined surface is inclined in a left-right direction, and the vertical surface is connected to a front surface of an arm of a V-shaped sharp end of the V-shaped block to define a continuous inclined surface.

In a preferred embodiment, the inner end of the first locking rod extends inward to define two first panels arranged in parallel in a vertical direction, and the sliding groove structure is disposed on an upper panel of the two first panels. An inner end of the second locking rod extends inward to define two second panels arranged in parallel in the vertical direction, and the torsion spring fixing portion is disposed on an upper panel of the two second panels.

In a preferred embodiment, both sides of front ends of an upper panel and a lower panel of the first locking rod comprise elastic clamps, and both sides of front ends of an upper panel and a lower panel of the second locking rod comprise elastic clamps.

In a preferred embodiment, the assembly-and-disassembly structure for the toilet cover comprises a sleeve fixing member, and the upper panel and the lower panel of the first locking rod and the upper panel and the lower panel of the second locking rod are respectively inserted into the sleeve fixing member from both sides of the sleeve fixing member. The sleeve fixing member comprises with one or more clamping grooves. Axial centers of two ends of the sleeve fixing member comprise a spring fixing column respectively, and the spring fixing columns are disposed with two reset springs.

In a preferred embodiment, the sliding portions of the two support abutting blocks are first slopes, and the first locking rod and the second locking rod comprise second slopes correspondingly.

In a preferred embodiment, a lower side of the first locking plate of the outer end of the first locking rod and a lower side of a second locking plate of an outer end of the second locking rod are vertically and integrally disposed with second slopes, and front ends of the first locking plate and the second locking plate comprise positioning grooves.

In a preferred embodiment, the assembly-and-disassembly structure for the toilet cover comprises a locking device, the locking device is configured to limit an interaction between each of the two support abutting blocks and the first locking rod and the second locking rod or separate the support abutting block from the first locking rod and the second locking rod.

In a preferred embodiment, the locking device comprises a damper cover, a limiting sliding block, and a limiting hook. The damper cover and a damper rotate synchronously, and a side of an inner wall of a hole of the damper cover comprises a space providing hole. The limiting sliding block is disposed above the two support abutting blocks. The limiting sliding block comprises a sliding protruding platform configured to enter into or separate from the space providing hole. A bottom of the limiting hook comprises a space providing groove), and a side of the space providing groove comprises a limiting bottom surface.

In a preferred embodiment, each of the two support abutting block comprises a limiting rib, and each of the two limiting ribs is configure to enter the space providing groove of the limiting hook.

In a preferred embodiment, the rotation shaft is a fixed rotation shaft. The locking device is disposed on the fixed rotation shaft, and an axial inner end of the fixed rotation shaft comprises a T-shaped slot. One of the first locking plate or a second locking plate and one of a vertical slope of the outer end of the first locking rod or a vertical slope of an outer end of the second locking rod are inserted into the T-shaped slot. A lower portion of an axial inner end of the fixed rotation shaft comprises a pair of guide grooves, and the limiting hook of the limiting sliding block is configured to slide on a corresponding one of the pair of guide grooves. A lower side of a middle portion of the fixed rotation shaft comprises a guide portion for a corresponding one of the two support abutting blocks.

In a preferred embodiment, the assembly-and-disassembly structure for the toilet cover comprises a sleeve, and the first locking rod, a sleeve fixing member, and the second locking rod are disposed in the sleeve in series.

Compared with the existing techniques, the technical solution of the present disclosure has the following advantages.

1. The presently described assembly-and-disassembly structure is simple to install. By aligning the support base and pressing the cover plate assembly vertically, assembly can be completed quickly. By again pressing the cover plate assembly vertically and pulling up the cover plate assembly, disassembly can be completed quickly.

2. In the presently described assembly-and-disassembly structure, an inner locking rod structure is adopted. The disassembly process requires that both the left side and right side are vertically pressed at the same time to trigger the unlocking function. In an abnormal state, such as might occur when only one of the left side or the right side is pressed or the cover plate assembly is shaky, the assembly-and-disassembly structure cannot be unlocked. Therefore, product safety and stability is improved.

3. The presently described assembly-and-disassembly structure adopts a damper cover give-way hole structure. When the cover plate assembly is at a zero degree state, the give-way hole is in an open state, and the cover plate assembly will not be erroneously unlocked under the downward force. Therefore, safety is guaranteed.

BRIEF DESCRIPTION OF THE DRAWING

The present disclosure will be further described with the combination of the accompanying embodiments and the accompanying drawings.

DETAILED DESCRIPTION OF THE EMBODIMENTS

Embodiment 1

Figure 1:
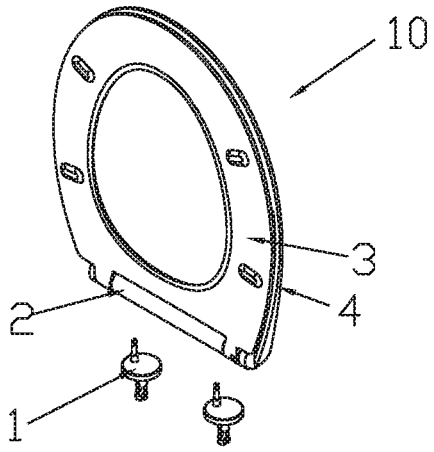
FIG. 1 illustrates a perspective view of an assembly-and-disassembly structure of a preferred embodiment.
Figure 2:
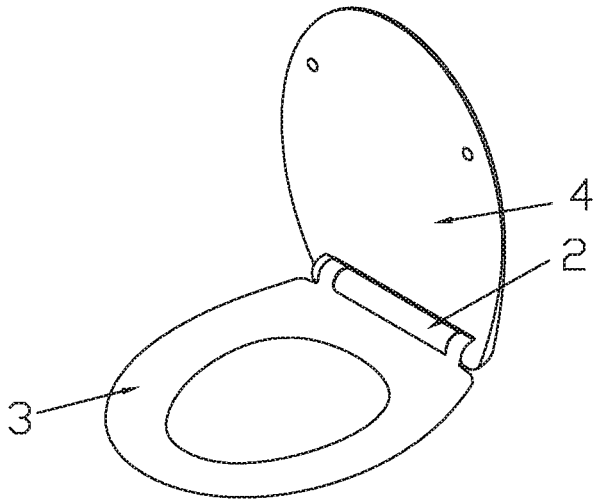
FIG. 2 illustrates a perspective view of a toilet cover of the preferred embodiment.
Figure 3:
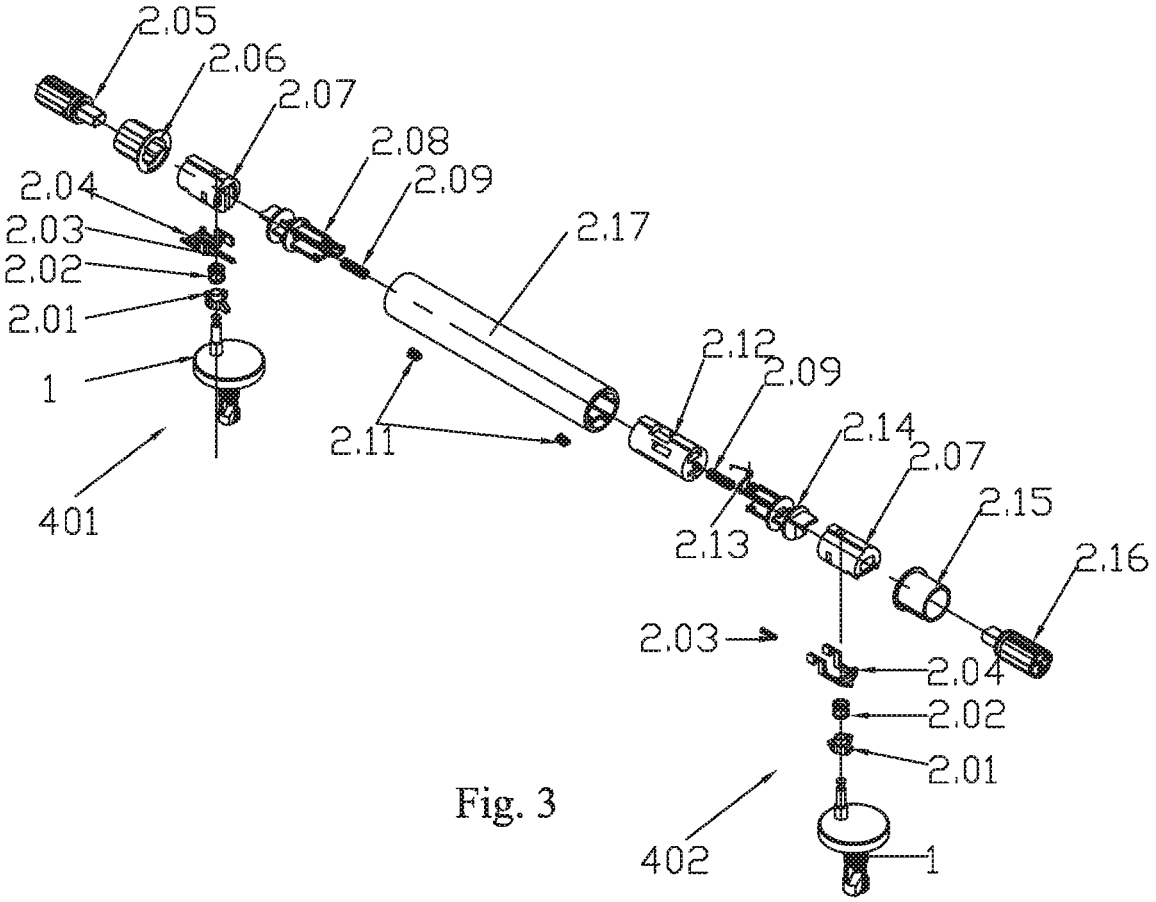
FIG. 3 illustrates an exploded perspective view of a sleeve assembly and a support base assembly of the preferred embodiment, showing internal components of the sleeve assembly.
Figure 4:
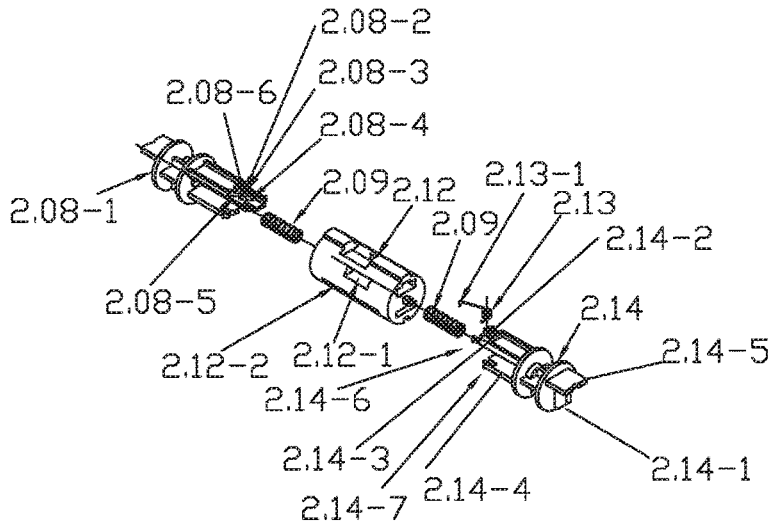
FIG. 4 illustrates a perspective view showing cooperation between a sleeve fixing member and a locking rod of the preferred embodiment.

Please refer to FIGS. 1-6, an assembly-and-disassembly structure for a toilet cover of the present disclosure comprises a cover plate assembly 10 (e.g., a toilet seat 3 and an upper cover 4), a sleeve assembly 2, and two support bases 1.

In this embodiment, the sleeve assembly 2 comprises a sleeve 2.17. An inner side of the sleeve 2.17 is disposed with a first locking rod 2.08, a torsion spring 2.13, and a second locking rod 2.14.

Figure 5:
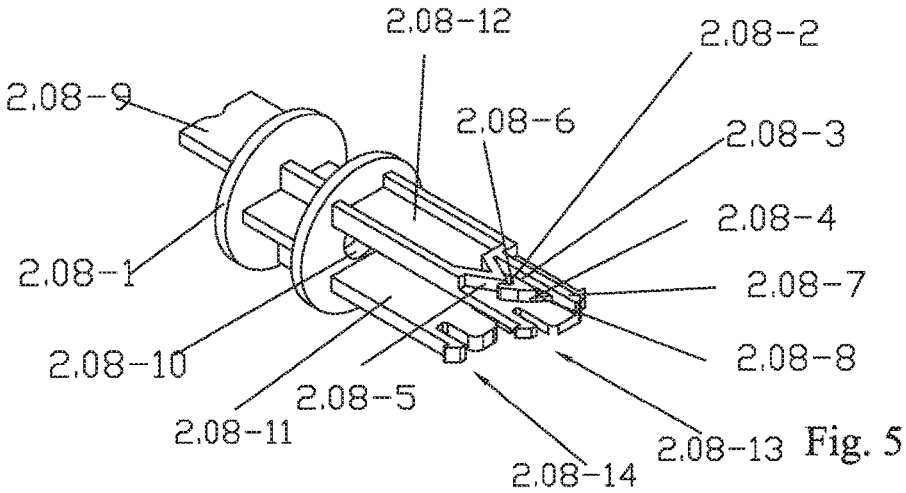
FIG. 5 illustrates a perspective view of a first locking rod of the preferred embodiment
Figure 11:
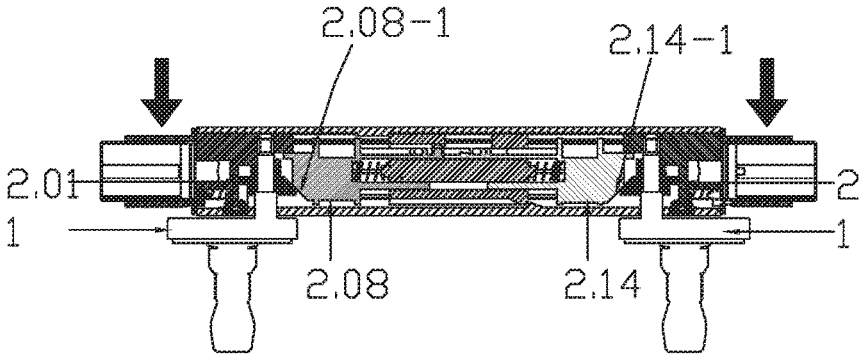
FIG. 11 illustrates a cross-sectional view of the preferred embodiment when in an unlocked state.
Figure 11A:
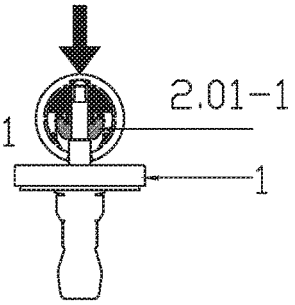
FIG. 11A illustrates a side view of FIG. 11.

Referring to FIGS. 5 and 11, an outer end of the first locking rod 2.08 comprises a locking plate 2.08-9 and a guide disk 2.08-10 in series. An inner end of the first locking rod 2.08 comprises a sliding groove structure 40 configured to enable a first end of the torsion spring 2.13 to move. The sliding groove structure 40 comprises a V-shaped groove 2.08-6 and a strip-shaped groove 2.08-3 connected to the V-shaped groove 2.08-6. A bottom of the locking plate 2.08-9 is vertically disposed with a first slope 2.08-1.

In this embodiment, the inner end of the first locking rod 2.08 extends inward to define an upper panel 2.08-12 and a lower panel 2.08-11 arranged in parallel in a vertical direction. An upper side of the upper panel 2.08-12 protrudes to define a V-shaped block 2.08-4. A V-shaped sharp end of the V-shaped block 2.08-4 faces a right end of the V-shaped block 2.08-4, and a rear side of the V-shaped groove 2.08-6 of the V-shaped block 2.08-4 is further disposed with a V-shaped guide surface 2.08-5. A side surface of the V-shaped block 2.08-4 comprises a block wall 2.08-7, and the strip-shaped groove 2.08-3 is disposed between the block wall 2.08-7 and the V-shaped block 2.08-4. A bottom of the strip-shaped groove 2.08-3 is higher than an upper surface of the first locking rod 2.08, and an intersection of the strip-shaped groove 2.08-3 and the bottom of the strip-shaped groove 2.08-3 defines a step 2.08-8. The block wall 2.08-7 is connected to the V-shaped guide surface 2.08-5.

In this embodiment, a vertical surface of the step 2.08-8 is an inclined surface, which is inclined in a left-right direction. The vertical surface of the step 2.08-8 is connected to a front surface of an arm of the V-shaped sharp end of the V-shaped block 2.08-4 to define a continuous inclined surface to facilitate a clamping position of the torsion spring 2.13 to be directed to a side of the V-shaped sharp end.

In this embodiment, both sides of front ends of the upper panel 2.08-12 and the lower panel 2.08-11 comprise elastic clamps 2.08-13 and 2.08-14.

A structure of the second locking rod 2.14 is similar to a structure of the first locking rod 2.08. An inner end of the second locking rod 2.14 extends inward to define an upper panel 2.14-3 and a lower panel 2.14-4 arranged in parallel in the vertical direction. A torsion spring fixing portion 2.14-2 is disposed on the upper panel 2.14-3. A bottom of a locking plate 2.14-5 of an outer end of the second locking rod 2.14 is vertically disposed with a second slope 2.14-1.

And, both sides of front ends of the upper panel 2.14-3 and the lower panel 2.14-4 comprise elastic clamps 2.14-6 and 2.14-7.

Figure 6:
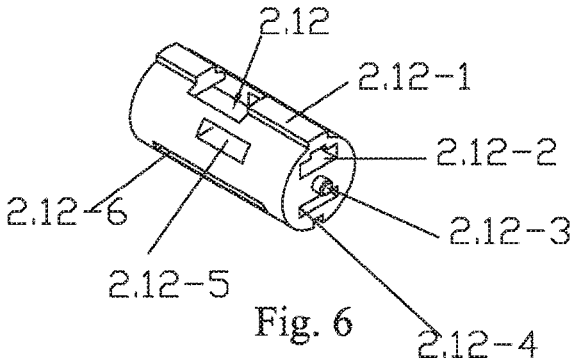
FIG. 6 illustrates a perspective view of the sleeve fixing member of the preferred embodiment.

In order to keep the first locking rod 2.08, the second locking rod 2.14, and the torsion spring 2.13 stably close and separate, a sleeve fixing member 2.12 is disposed between the two locking rods (e.g., the first locking rod 2.08 and the second locking rod 2.14). Referring to FIG. 6, two end surfaces of the sleeve fixing member 2.12 each comprises a spring fixing column 2 12-3 respectively. An outer surface of the sleeve fixing member 2.12 comprises one or more positioning ribs 2.12-1 along an axial direction of the sleeve fixing member 2.12, and an inner side of the sleeve fixing member 2.12 comprises an upper connecting hole 2.12-2 and a lower connecting hole 2.12-4 disposed in the axial direction of the sleeve fixing member 2.12 for connecting to the two locking rods (e.g., the first locking rod 2.08 and the second locking rod 2.14). A shaft side of the upper connecting hole 2.12-2 comprises an upper shaft side groove 2.12-5 (namely a first clamping groove 2.12-5), and a shaft side of the lower connecting hole 2.12-4 comprises a lower shaft side groove 2.12-6 (namely a second clamping groove 2.12-6). The upper-panel 2.08-12 of the first locking rod 2.08 and upper panel 2.14-3 of the second locking rod 2.14 are respectively inserted into two ends of the upper connecting hole 2.12-2. The lower panel 2.08-11 of the first locking rod 2.08 and the lower panel 2.14-4 of the second locking rod 2.14 are respectively inserted into two ends of the lower connecting hole 2.12-3. The elastic clamps 2.08-13 and 2.08-14 at the front ends of the upper panel 2.08-12 and the lower panel 2.08-11 of the first locking rod 2.08 and the elastic clamps 2.14-6 and 2.14-7 at the front ends of the upper panel 2.14-3 and the lower panel 2.14-4 of the second locking rod 2.14 are snapped and guided through the corresponding upper shaft side groove 2.12-5 and the corresponding lower shaft side groove 2.12-6, respectively.

In this embodiment, the sleeve assembly 2 further comprises a pair of support abutting blocks 2.01 and two dampers (a first damper 2.05 and a second damper 2.16 of the two dampers). The upper cover 4 and the toilet seat 3 are connected to the sleeve assembly 2 by the two dampers.

Figure 7:
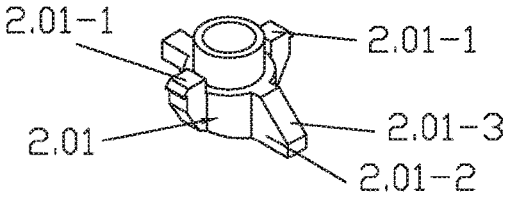
FIG. 7 illustrates a perspective view of a support base abutting block of the preferred embodiment.

Referring to FIG. 7, each support abutting block 2.01 of the pair of support abutting blocks 2.01 surrounds a support rod of each support base of the two support bases 1. A side surface of each support abutting block 2.01 of the pair of support abutting blocks 2.01 comprises two limiting ribs 2.01-1 extending in a radial direction, and a thrusting rib 2.01-2 is disposed between the two limiting ribs 2.01-1. The thrusting rib 2.02 comprises a third slope 2.01-3.

Figure 8:
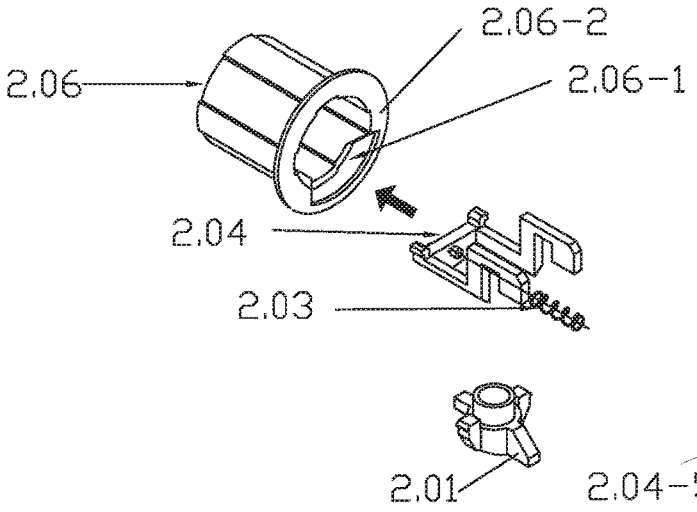
FIG. 8 illustrates a perspective view showing cooperation between a damper cover, a limiting sliding block, and the support base abutting block of the preferred embodiment.
Figure 8A:
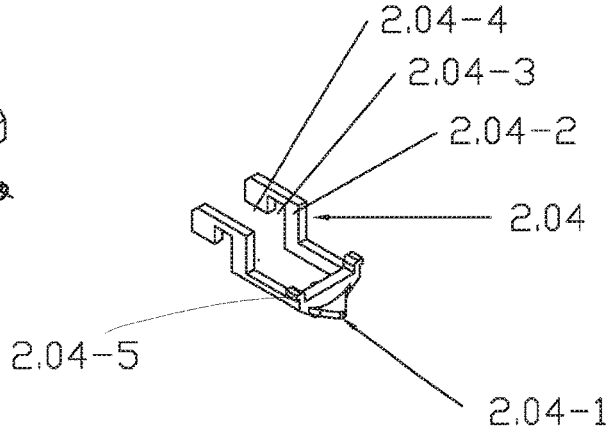
FIG. 8A illustrates a perspective view of the limiting sliding block of the preferred embodiment.

An upper side of each support abutting block 2.01 of the pair of support abutting blocks 2.01 is disposed with a limiting sliding block 2.04. Referring to FIG. 8, a first end of the limiting sliding block 2.04 comprises a sliding protruding platform 2.04-1, and a second end of the limiting sliding block 2.04 comprises a pair of limiting hooks 2.04-2. In this embodiment, a bottom of each limiting hook 2.04-2 of the pair of limiting hooks 2.04-2 comprises a space providing groove 2.04-3. The two limiting ribs 2.01-1 can be inserted into the space providing grooves 2.04-3. A first side of the space providing groove 2.04-3 is a limiting bottom 2.04-4. Two sides of the first end of the limiting sliding block 2.04 disposed with the sliding protruding platform 2.04-1 respectively comprise a limiting lock hook 2.04-5.

Figure 14A:
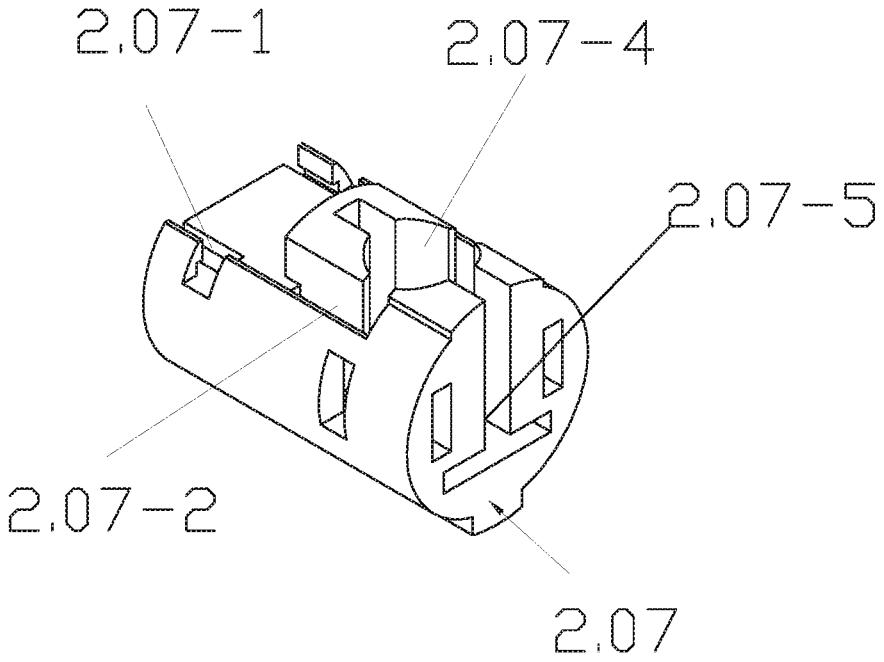
FIG. 14A illustrates a perspective view of a fixed rotation shaft of the preferred embodiment in which a bottom surface of the fixed rotation shaft is facing upward.
Figure 14B:
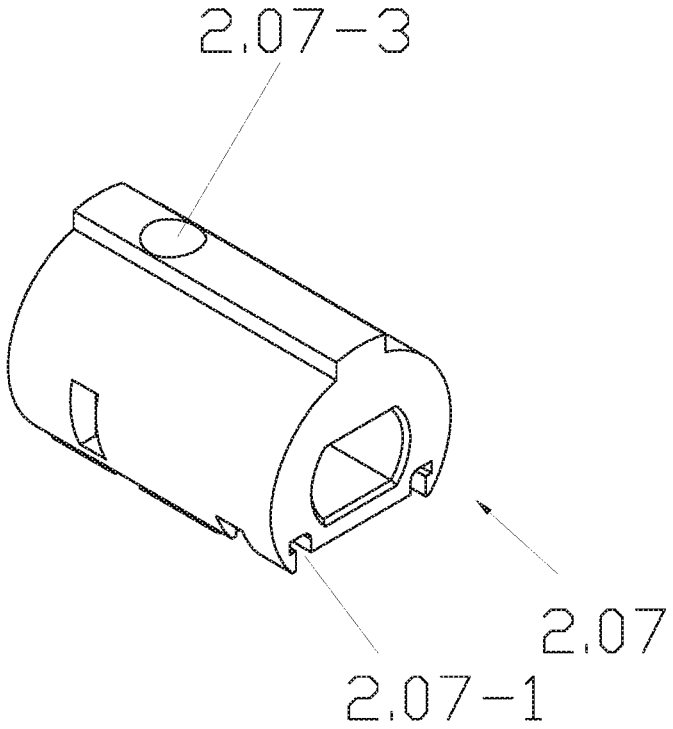
FIG. 14B illustrates a perspective view of a fixed rotation shaft of the preferred embodiment in which the bottom surface of the fixed rotation shaft is facing downward.

In this embodiment, the assembly-and-disassembly structure for a toilet cover further comprises a pair of fixed rotation shafts 2.07 (two ends of the assembly-and-disassembly structure for a toilet cover respectively comprise a first fixed rotation shaft and a second fixed rotation shaft of the pair of fixed rotation shafts 2.07, with the first fixed rotation shaft 2.08 taken as an example). Referring to FIG. 14, an axial inner end of the first fixed rotation shaft comprises a T-shaped slot 2.07-5. The locking plate 2.08-9 of the outer end of the first locking rod and the first slope 2.08-1 are inserted into the T-shaped slot 2.07-5. A lower portion of an axial outer end of the first fixed rotation shaft comprises a pair of guide grooves 2.07-2, and the pair of limiting hooks 2.04-2 of the limiting sliding block 2.04 are configured to slide in the pair of guide grooves 2.07-2. A position adjacent to an inner end of a bottom surface of the first fixed rotation shaft comprises a pair of second grooves 2.07-1 disposed in a left-right direction to enable sliding the limiting lock hooks 2.04-5 of the limiting sliding block 2.04 in the left-right direction. A lower side of a middle portion of the first fixed rotation shaft comprises a guide portion 2.07-4 for a corresponding one of the pair of support abutting blocks 2.01, and the first fixed rotation shaft comprises a through hole 2.07-3 passing through an upper surface and a lower surface of the first fixed rotation shaft. The through hole 2.07-3 is configured to receive a plug of each support base of the two support bases 1.

In this embodiment, the assembly-and-disassembly structure for the toilet cover further comprises a left damper cover 2.06 and a right damper cover 2.15. The left damper cover 2.06 and the right damper cover 2.15 are disposed in the sleeve 2.17 and are disposed on the two dampers (e.g., the first damper 2.05 and the second damper 2.16) disposed on two sides of the sleeve 2.17. A side of an inner wall of a hole of each of the left damper cover 2.06 and the right damper cover 2.15 comprises a space providing hole 2.06-1.

At least the left damper cover 2.06, the limiting sliding block 2.04, and the limiting hook 2.04-2 defines a locking device 30. Also, at least the right damper cover 2.15, the limiting sliding block 2.04, and the limiting hook 2.04-2 defines a locking device 30.

In this embodiment, the sleeve fixing member 2.12 is disposed on a middle portion of the sleeve assembly 2. A pair of springs 2.09, the first locking rod 2.08, and the second locking rod 2.14 are disposed on two sides of the sleeve fixing member 2.12. The pair of fixed rotation shafts 2.07 are disposed on two sides of the first locking rod 2.08 and the second locking rod 2.14. The pair of damper covers (the left damper cover 2.06 and the right damper cover 2.15) are disposed on two sides of the pair of fixed rotation shaft 2.07, and the two dampers are disposed in the pair of damper covers.

At least the two limiting sliding blocks 2.04 respectively define locking rod resetting devices 401 and 402.

Figure 9:
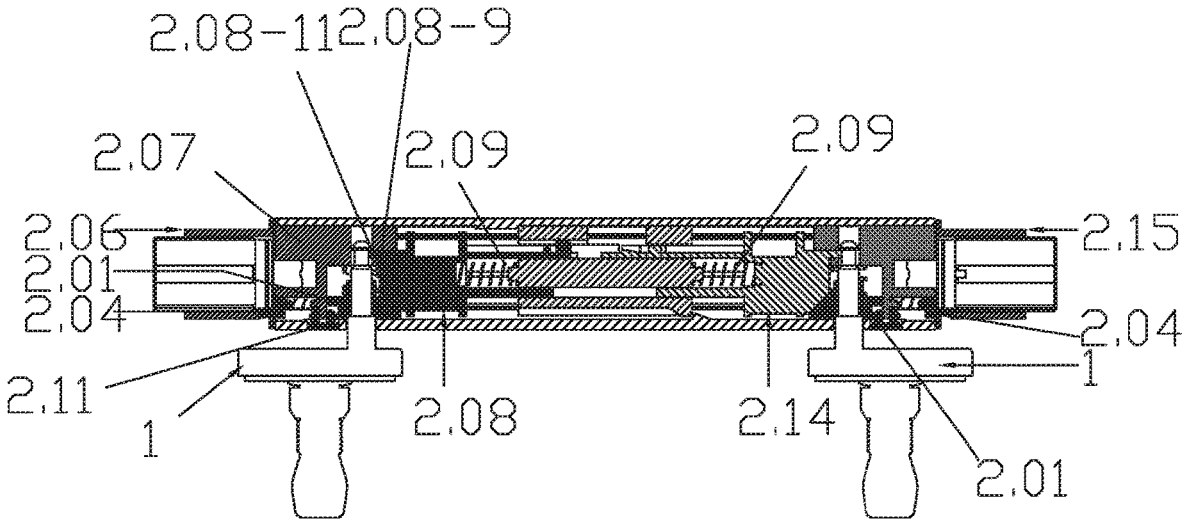
FIG. 9 illustrates a cross-sectional view of the preferred embodiment when in a locked state.
Figure 10A:
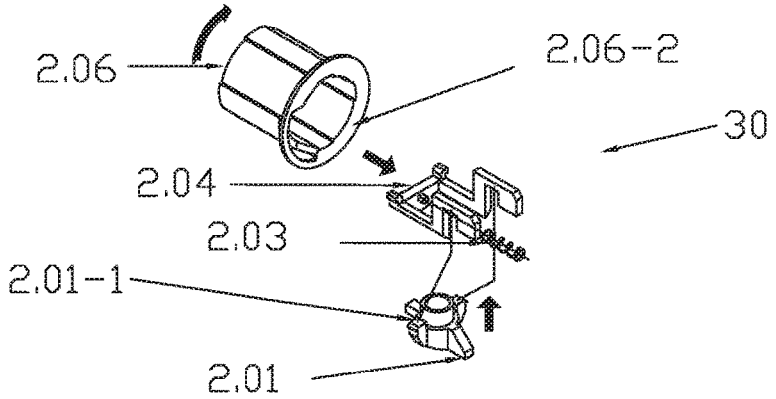
FIG. 10A illustrates an exploded perspective view of each component during a locking process of the preferred embodiment.
Figure 10B:
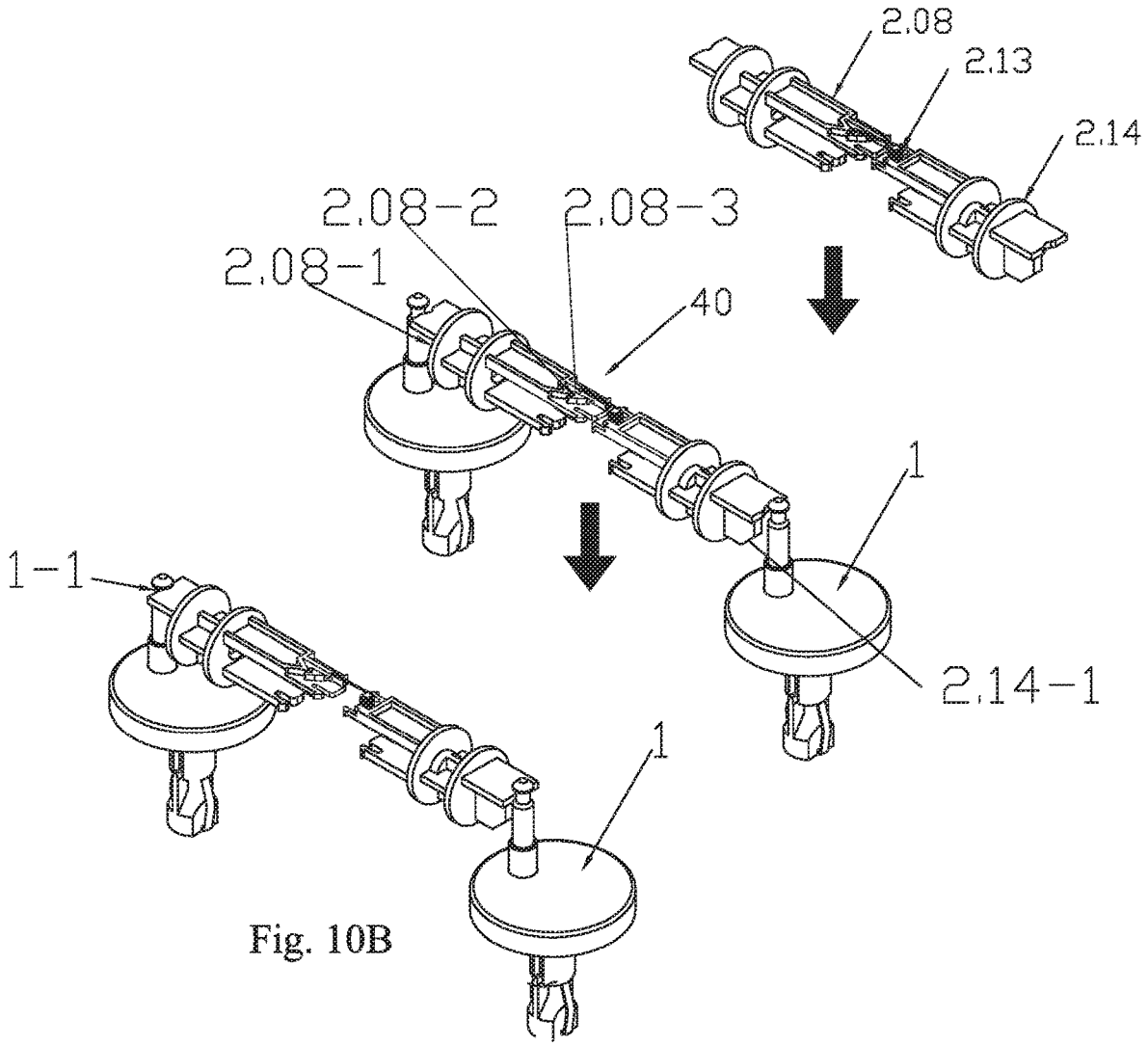
FIG. 10B illustrates a perspective view of the locking process of the combined components.

A locking process of the present disclosure is described with reference to FIGS. 9 and 10 (e.g., with the first fixed rotation shaft 2.08 taken as an example).

The upper cover 4 and the toilet seat 3 are turned upward at a ninety degree angle, the upper cover 4 and the toilet seat 3 are pressed down from the top, and the left damper cover 2.06 is rotated synchronously by 90°. The space providing hole 2.06-1 of the left damper cover 2.06 is gradually transitioned from an open state to a closed state, forcing the sliding protruding platform 2.04-1 disposed on the limiting sliding block 2.04 to move to the end surface (a plane 2.06-2). At the same time, the two limiting ribs 2.01-1 and the space providing groove 2.04-3 of the limiting sliding block 2.04 of the support abutting block 2.01 are located on the same vertical plane, and the two limiting ribs 2.01-1 can enter the space providing groove 2.04-3.

When an external force is applied, the support abutting block 2.01 is forced to move upward by the support base 1, the third slope 2.01-3 can lift the first slope 2.08-1 of the first locking rod 2.08 (on the second locking rod 2.14, it is the second slope 2.14-1), and the first locking rod 2.08 and the second locking rod 2.14 are forced to move toward the center of the sleeve 2.17. During movement of the second locking rod 2.14 on the left, a snap 2.13-1 of the torsion spring 2.13 is moved from a bottom of the V-shaped groove 2.08-6 into the elongated groove 2.08-3 along the guide surface. At this time, the first locking rod 2.08 and the second locking rod 2.14 are separated under the force of the springs 2.09, and the first locking rod 2.08 snaps into a locking groove 1-1 of the support base 1 to complete the locking of the cover plate assembly.

Figure 12A:
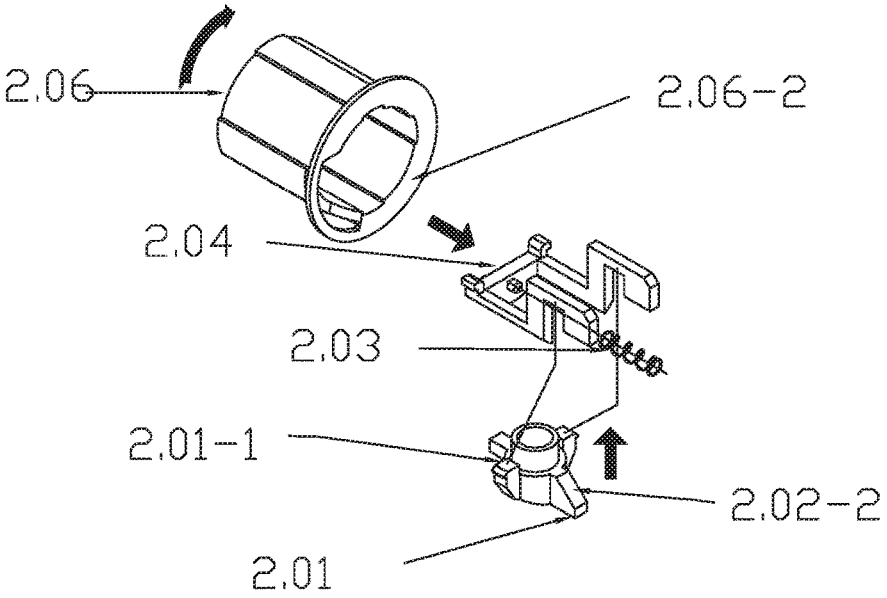
FIG. 12A illustrates exploded perspective view of each component during an unlocking process of the preferred embodiment.
Figure 12B:
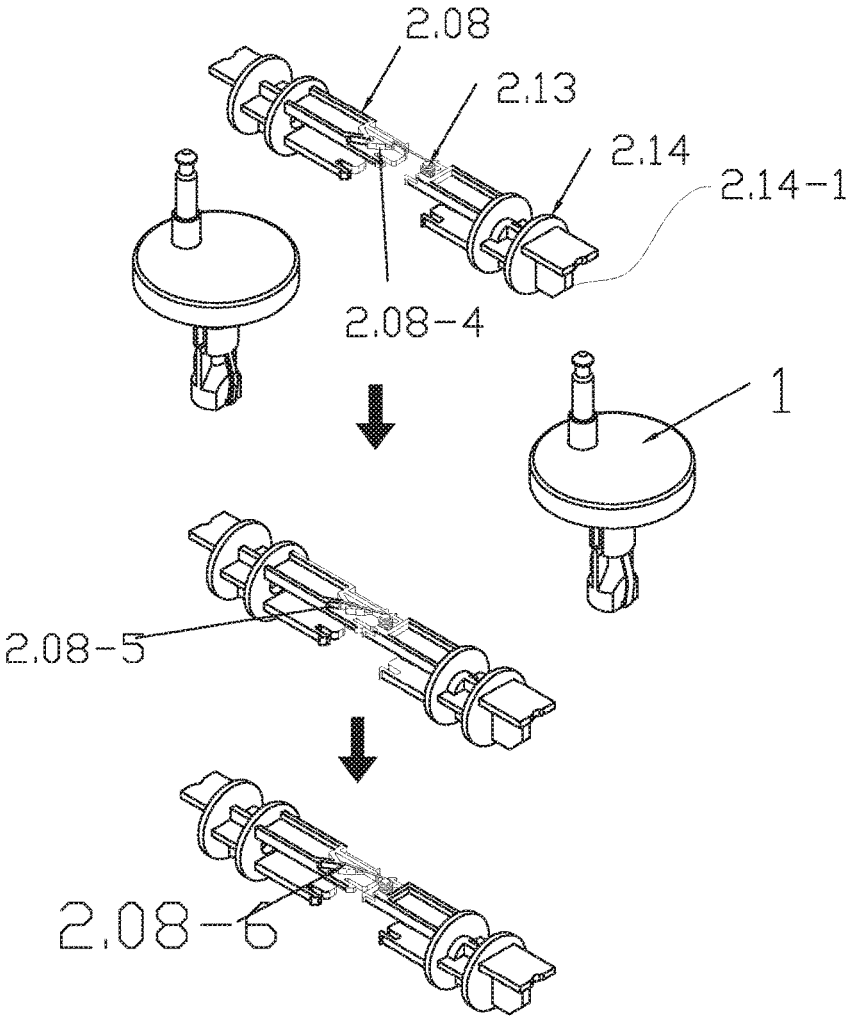
FIG. 12B illustrates a perspective view of the unlocking process of the combined components.
Figure 13:
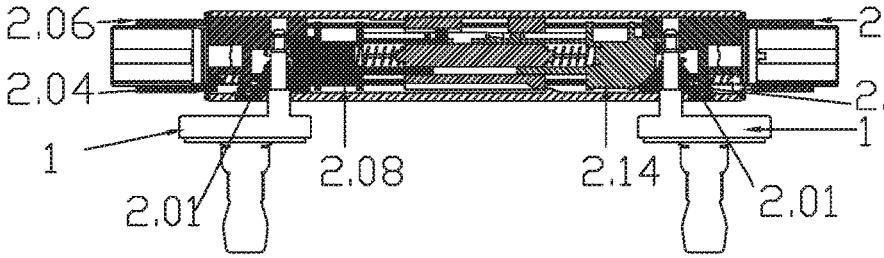
FIG. 13 illustrates a cross-sectional view of the preferred embodiment when in a use state.
Figure 13A:
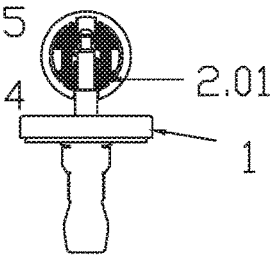
FIG. 13A is a side view of FIG. 13.

An unlocking process of the present is described with reference to FIGS. 11 and 12 (e.g., with the first fixed rotation shaft 2.08 taken as an example):

When the cover plate assembly, namely the toilet seat 3 and the upper cover 4, are turned at ninety degrees relative to the toilet, the toilet seat 3 and the upper cover 4 are pressed down again from the top. After the left damper cover 2.06 is rotated synchronously by 90°, the space providing hole 2.06-1 is gradually transitioned from the open state to the closed state, forcing the sliding protruding platform 2.04-1 on the limiting sliding block 2.04 to move to the end surface (the plane 2.06-2). At the same time, the limiting rib 2.01-1 of the support abutting block 2.01 and the space providing groove 2.04-3 of the limiting sliding block 2.04 are located on the same vertical plane, and the limiting rib 2.01-1 can enter the space providing groove 2.04-3.

When an external force is applied, the support abutting block 2.01 is forced to move upward by the support base 1, the third slope 2.01-3 can lift a first slope 2.08-1 of the first locking rod 2.08 (on the second locking rod 2.14, it is the second slope 2.14-1), and the first locking rod 2.08 and the second locking rod 2.14 are forced to move to the center of the sleeve 2.17. During movement of the second locking rod 2.14, the snap 2.13-1 of the torsion spring 2.13 moves into the V-shaped guide surface 2.08-5 along the V-shaped block 2.08-4 and then enters the bottom of the V-shaped groove 2.08-6 along the V-shaped guide surface 2.08-5. The first locking rod 2.08 is locked to the second locking rod 2.14 due to the snap 2.13-1. The first locking rod 2.08 and the second locking rod 2.14 are separated from the support base 1 to complete the unlocking of the cover plate assembly.

In a use state, when the cover plate assembly, namely the upper cover 4 and the toilet seat 3, are turned at ninety degrees relative to the toilet and under a unidirectional force, one of the first locking rod 2.08 or the second locking rod 2.14 moves toward the center of the sleeve 2.17. Due to the relative distance between the torsion spring 2.13 on the second locking rod 2.14 and the first locking rod 2.08, the snap 2.13-1 will not reach the V-shaped guide surface 2.08-5, and an unlock function will not be able to be triggered. The cover plate assembly that cannot be pulled up due to a misoperation that improves the safety and stability of the product during use and disassembly.

In the use state, when the cover plate assembly, namely the upper cover 4 and the toilet seat 3, are turned at zero degrees relative to the toilet, the space providing hole 2.06-1 in the left damper cover 2.06 is in an open state, and the sliding protruding platform 2.04-1 of the limiting sliding block 2.04 can enter into the space providing hole 2.06-1 due to a force of a spring 2.03. At this time, the limiting bottom surface 2.04-4 of limiting hook 2.04-2 is located above the two limiting ribs 2.01-1, restricting upward displacement of the two limiting ribs 2.01-1. The first locking rod 2.08 and the second locking rod 2.14 will not move when the cover plate assembly is under downward force, and the cover will not be unlocked by mistake.

It will be apparent to those skilled in the art that various modifications and variation can be made in the present disclosure without departing from the spirit or scope of the disclosure. Thus, it is intended that the present disclosure cover the modifications and variations of this disclosure provided they come within the scope of the appended claims and their equivalents.

What is claimed is:

1. An assembly-and-disassembly structure for a toilet cover, comprising:

a cover plate assembly, two support bases, and two rotation shafts, wherein:

the cover plate assembly is connected to the two support bases by the two rotation shafts, a first locking rod and a first locking rod resetting device are disposed in a first rotation shaft of the two rotation shafts, a second locking rod and a second locking rod resetting device are disposed in a second rotation shaft of the two rotation shafts, a torsion spring is disposed between the first locking rod and the second locking rod, a first end of the torsion spring is movably connected to the first locking rod, a second end of the torsion spring is connected to the second locking rod, the second locking rod comprises a torsion spring fixing portion, an outer end of the first locking rod comprises a first locking plate, an inner end of the first locking rod comprises a sliding groove structure configured to receive the first end of the torsion spring to move, the sliding groove structure comprises a V-shaped groove and a strip-shaped groove connected to the V-shaped groove, each of the two support bases comprises a support abutting block, the two support abutting blocks comprise sliding portions configured to respectively abut the first locking rod and the second locking rod to drive the first locking rod and the second locking rod to move laterally, when the two support abutting blocks respectively abut the first locking rod and the second locking rod to bring the first locking rod close to the second locking rod, the first end of the torsion spring is configured to move to a bottom of the V-shaped groove, and the first locking rod and the second locking rod separate from locking grooves of the two support bases, and when the two support abutting blocks respectively abut the first locking rod and the second locking rod to separate the first locking rod from the second locking rod, the first end of the torsion spring is configured to move to the strip-shaped groove, and the first locking rod and the second locking rod are locked to the locking grooves of the two support bases.

2. The assembly-and-disassembly structure for the toilet cover according to claim 1, wherein:

an upper side of an inner side of the first locking rod protrudes to define a V-shaped block comprising the V-shaped groove, a rear side of the V-shaped groove is disposed with a V-shaped guide surface, a side surface of the V-shaped block comprises a block wall, the strip-shaped groove is disposed between the block wall and the V-shaped block, a bottom of the strip-shaped groove is higher than an upper surface of the first locking rod, and an intersection of the strip-shaped groove and the bottom of the strip-shaped groove defines a step.

3. The assembly-and-disassembly structure for the toilet cover according to claim 2, wherein:

a vertical surface of the step is an inclined surface, the inclined surface is inclined in a left-right direction, and the vertical surface is connected to a front surface of an arm of a V-shaped sharp end of the V-shaped block to define a continuous inclined surface.

4. The assembly-and-disassembly structure for the toilet cover according to claim 1, wherein:

the inner end of the first locking rod extends inward to define two first panels arranged in parallel in a vertical direction, the sliding groove structure is disposed on an upper panel of the two first panels, an inner end of the second locking rod extends inward to define two second panels arranged in parallel in the vertical direction, and the torsion spring fixing portion is disposed on an upper panel of the two second panels.

5. The assembly-and-disassembly structure for the toilet cover according to claim 1, wherein:

both sides of front ends of an upper panel and a lower panel of the first locking rod comprise elastic clamps, and both sides of front ends of an upper panel and a lower panel of the second locking rod comprise elastic clamps.

6. The assembly-and-disassembly structure for the toilet cover according to claim 5, further comprising:

a sleeve fixing member, the upper panel and the lower panel of the first locking rod and the upper panel and the lower panel of the second locking rod are respectively inserted into the sleeve fixing member from both sides of the sleeve fixing member, the sleeve fixing member comprises with one or more clamping grooves, axial centers of two ends of the sleeve fixing member comprise a spring fixing column respectively, and the spring fixing columns are disposed with two reset springs.

7. The assembly-and-disassembly structure for the toilet cover according to claim 1, wherein:

the sliding portions of the two support abutting blocks are first slopes, and the first locking rod and the second locking rod comprise second slopes correspondingly.

8. The assembly-and-disassembly structure for the toilet cover according to claim 1, wherein:

a lower side of the first locking plate of the outer end of the first locking rod and a lower side of a second locking plate of an outer end of the second locking rod are vertically and integrally disposed with second slopes), and front ends of the first locking plate and the second locking plate comprise positioning grooves.

9. The assembly-and-disassembly structure for a toilet cover according to claim 1, further comprising:

a locking device, wherein the locking device is configured to limit an interaction between each of the two support abutting blocks and the first locking rod and the second locking rod or separate the support abutting block from the first locking rod and the second locking rod.

10. The assembly-and-disassembly structure for a toilet cover according to claim 9, wherein:

the locking device comprises:

a damper cover, a limiting sliding block, and a limiting hook, the damper cover and a damper rotate synchronously, a side of an inner wall of a hole of the damper cover comprises a space providing hole, the limiting sliding block is disposed above the two support abutting blocks, the limiting sliding block comprises a sliding protruding platform configured to enter into or separate from the space providing hole, a bottom of the limiting hook comprises a space providing groove, and a side of the space providing groove comprises a limiting bottom surface.

11. The assembly-and-disassembly structure for the toilet cover according to claim 10, wherein:

each of the two support abutting block comprises a limiting rib, and each of the two limiting ribs is configure to enter the space providing groove of the limiting hook.

12. The assembly-and-disassembly structure for the toilet cover according to claim 10, wherein:

the rotation shaft is a fixed rotation shaft, the locking device is disposed on the fixed rotation shaft, an axial inner end of the fixed rotation shaft comprises a T-shaped slot, one of the first locking plate or a second locking plate and one of a vertical slope of the outer end of the first locking rod or a vertical slope of an outer end of the second locking rod are inserted into the T-shaped slot, a lower portion of an axial inner end of the fixed rotation shaft comprises a pair of guide grooves, the limiting hook of the limiting sliding block is configured to slide on a corresponding one of the pair of guide grooves, and a lower side of a middle portion of the fixed rotation shaft comprises a guide portion for a corresponding one of the two support abutting blocks.

13. The assembly-and-disassembly structure for the toilet cover according to claim 10, further comprising:

a sleeve, wherein the first locking rod, a sleeve fixing member), and the second locking rod are disposed in the sleeve in series.

14. The assembly-and-disassembly structure for the toilet cover according to claim 2, wherein:

the inner end of the first locking rod extends inward to define two first panels arranged in parallel in a vertical direction, the sliding groove structure is disposed on an upper panel of the two first panels, an inner end of the second locking rod extends inward to define two second panels arranged in parallel in the vertical direction, and the torsion spring fixing portion is disposed on an upper panel of the two second panels.

15. The assembly-and-disassembly structure for the toilet cover according to claim 2, wherein:

both sides of front ends of an upper panel and a lower panel of the first locking rod comprise elastic clamps, and both sides of front ends of an upper panels and a lower panel of the second locking rod comprise elastic clamps.

16. The assembly-and-disassembly structure for the toilet cover according to claim 2, wherein:

the sliding portions of the two support abutting blocks are first slopes, and the first locking rod and the second locking rod comprise second slopes correspondingly.

17. The assembly-and-disassembly structure for the toilet cover according to claim 7, wherein:

a lower side of the first locking plate of the outer end of the first locking rod and a lower side of a second locking plate of an outer end of the second locking rod are vertically and integrally disposed with the second slopes, and front ends of the first locking plate and the second locking plate comprise positioning grooves.

* * * * *